US005652947A

United States Patent [19]

Izumizaki

[11] Patent Number: 5,652,947

[45] Date of Patent: Jul. 29, 1997

[54] IMAGE FORMING APPARATUS INCLUDING A TWO-STAGE TONER SUPPLY SYSTEM

[75] Inventor: Masami Izumizaki, Yokohama, Japan

[73] Assignee: Canon Kabushiki Kaisha, Tokyo, Japan

[21] Appl. No.: 386,343

[22] Filed: Feb. 10, 1995

Related U.S. Application Data

[63] Continuation of Ser. No. 62,340, May 17, 1993.

[30] Foreign Application Priority Data

May 18, 1992 [JP] Japan ..... 4-148895

[51] Int. Cl.[6] ..... G03G 21/00

[52] U.S. Cl. ..... 399/58; 399/62; 399/258

[58] Field of Search ..... 355/260, 246, 355/208; 118/688, 689; 399/53, 58, 61, 62, 258

[56] References Cited

U.S. PATENT DOCUMENTS

| | | | |
|---|---|---|---|
| 4,768,055 | 8/1988 | Takamatsu et al. | 355/200 X |
| 4,825,244 | 4/1989 | Hediger | 118/653 X |
| 4,937,625 | 6/1990 | Kato et al. | 355/245 |
| 4,943,830 | 7/1990 | Sulenski | 355/245 |
| 4,977,429 | 12/1990 | Tani et al. | 355/260 |
| 5,036,363 | 7/1991 | Iida et al. | 355/246 |
| 5,057,870 | 10/1991 | Aoki | 355/246 |
| 5,124,751 | 6/1992 | Fukui et al. | 355/246 |
| 5,142,332 | 8/1992 | Osawa et al. | 355/208 |
| 5,150,162 | 9/1992 | Saito | 355/260 |
| 5,153,643 | 10/1992 | Nagakura | 355/215 |
| 5,237,373 | 8/1993 | Aimoto et al. | 355/298 |
| 5,249,020 | 9/1993 | Takano | 355/260 |
| 5,253,020 | 10/1993 | Matsushita et al. | 355/260 |
| 5,257,076 | 10/1993 | Nishimura | 355/246 |
| 5,365,319 | 11/1994 | Sakemi et al. | 355/246 |

*Primary Examiner*—William J. Royer

*Attorney, Agent, or Firm*—Fitzpatrick, Cella, Harper & Scinto

[57] ABSTRACT

An image forming apparatus includes a developer container comprising toner particles and carrier particles. A developer carrying member is disposed in the developer container, for carrying the developer to a developing zone where an electrostatic latent image is developed. A first toner container contains toner particles, and a first supply mechanism supplies toner particles from the first toner container to the developer container in response to a toner supply signal, to maintain a ratio of toner particles to carrier particles constant. A second toner container contains toner particles, and a second supply mechanism supplies toner particles from the second toner container to the first toner container, to maintain the amount of toner particles in the first container constant.

13 Claims, 7 Drawing Sheets

IMAGE FORMING APPARATUS INCLUDING A TWO-STAGE TONER SUPPLY SYSTEM

This application is a continuation of application Ser. No. 08/062,340 filed May 17, 1993.

FIELD OF THE INVENTION AND RELATED ART

The present invention relates to an image forming apparatus of a copying machine, printer or the like. The image forming apparatus is of the electrophotographic type, electrostatic recording type or the like in which an electrostatic latent image is developed on an image bearing member by depositing developer, to form a visualized image, and more particularly to an image forming apparatus provided with a developer content control device for controlling toner content in a two component developer.

For a developing apparatus in an image forming apparatus of an electrophotographic or electrostatic recording type, a two component developer mainly comprising toner particles and carrier particles is used. Particularly in a color image forming apparatus capable of forming full-color images or multi-color images through electrophotographic process, a two component developer is generally used in the developing device from the standpoint of the color reproducibility. As is known, a toner content in the two component developer, that is, a ratio of the weight of the toner particles relative to the total weight of the toner particles and carrier particles, is a significant factor from the standpoint of stabilizing the image quality. The toner particles in the developer are consumed by the developing operation, and therefore, the toner content changes gradually. Therefore, an automatic toner content regulator or controller (ART) is used, by which the toner content at the developer is detected in proper timing intervals, and in accordance with the change, the toner is replenished into the two component developer, thus controlling the toner content in a predetermined range so that the image quality is maintained.

Generally, in such an image forming apparatus, a toner container, that is, a hopper having a large capacity for containing toner particles, is provided in addition to a developer container for accommodating the two component developer. The toner is supplied into the developer container from the hopper through a supplying mechanism operative in response to a toner supply signal, the supply mechanism comprising, for example, a rotatable screw, a rotatable roller or the like. Even if the toner supplying mechanism is operated for the same period of time, the amount of the toner supplied into the developer container is different when a large amount of toner particles is in the hopper versus when a small amount of toner particles is in the hopper. When a large amount of toner particles is in the hopper, the pressure among the toner particles at the toner supply position in the supplying mechanism is high, and therefore, the density thereof is high. When, however, the amount of toner particles remaining in the hopper is small, the toner powder density is low. The toner powder density is influential to the flowability of the toner particles, and therefore, to the toner feeding efficiency. When, for example, the toner particles are fed and supplied by a rotatable screw, the feeding efficiency is low, when the toner density is high, and if the toner density is low, the feeding efficiency is high.

Accordingly, even if a toner supply signal is generated corresponding to an amount of toner consumed by the developing device, or in response to a detected toner density, the amount of the toner actually supplied into the developer container by the supply mechanism operative in response to the signal, varies depending on the amount of the toner remaining in the hopper, and therefore, it does not correctly correspond to the level or period indicated by the toner supply signal.

Thus, despite the toner content control, the actual toner content falls outside the desired range with the result of deterioration of the developed image quality, toner scattering or the like.

These inconveniences are particularly significant in the case of an image forming apparatus in which an original to be copied is read by a photoelectric transducer such as a CCD to generate an image signal, and an electrostatic latent image is formed in response thereto, or the electrostatic latent image is formed in response to output image signals from a computer or the like, if the toner supply signal is generated using such image signals. The reasons will be described below. In the case of an image forming apparatus in which the toner content in the two component developer is detected by a photosensor or magnetic sensor, and the toner supply signal is generated in response to an output thereof, the toner content may fall outside the desired range. Even if this occurs, a toner content out of the predetermined range is detected by the sensor, and the toner content correcting operation is repeated in response to the detection. Therefore, the toner content of the developer converges to the predetermined range sooner or later. However, in the image forming apparatus in which the toner supply signal is generated using the image signal, the following problem arises. If the toner supply signal is repeatedly generated, the toner supply error is not corrected, but the error is increased without limit. This is so, because the toner supply signal is generated in accordance with the image signal, and it is based on a prediction of the toner consumption. Even if the toner supply error occurs in the supply mechanism, the toner supply signal is not responsive to the actual toner content. An image forming apparatus in which the toner supply signal is generated on the basis of the image signal, is disclosed in U.S. Ser. No. 838,039.

SUMMARY OF THE INVENTION

Accordingly, it is a principal object of the present invention to provide an image forming apparatus in which an amount of the toner particles correctly corresponding to the toner supply signal is supplied into the developer container containing the developer comprising the toner particles and carrier particles.

It is another object of the present invention to provide an image forming apparatus in which a toner supply signal is generated using the image signal, and wherein the toner content in the developer container does not deviate too much from the target level.

It is a further object of the present invention to provide an image forming apparatus in which a toner supply error of the toner supplying mechanism for the developer container is minimized, thus increasing the toner supply accuracy.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The present invention is applicable to an image forming apparatus in which an electrostatic latent image is formed in response to an image information signal through an electrophotographic or electrostatic recording process or the like on an image bearing member in the form of an electrophotographic photosensitive member or dielectric member, for example, and the electrostatic latent image is developed by a developing device using a two component developer mainly comprising toner particles and carrier particles into a visualized image (toner image). Thereafter, the visualized image is transferred onto a transfer material such as taper, whereafter the image is fixed into a permanent image by fixing means.

Figure 1:
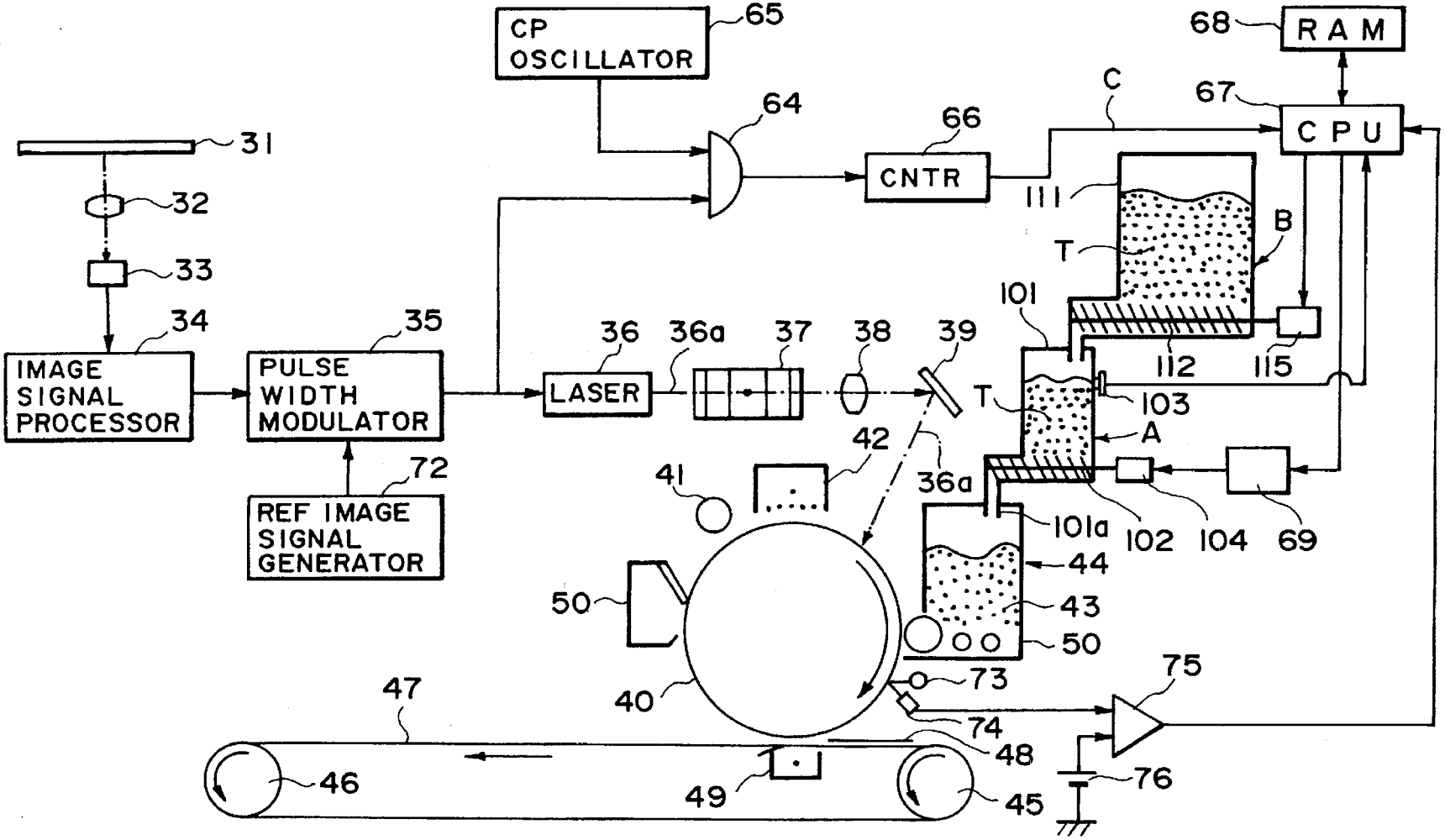
FIG. 1 is a schematic diagram of an overall system of the image forming apparatus according to an embodiment of the present invention.

Referring to FIG. 1, a description will be made of the overall system of an image forming apparatus according to an embodiment of the present invention.

Figures 2A, 2B, 2C, 2D:
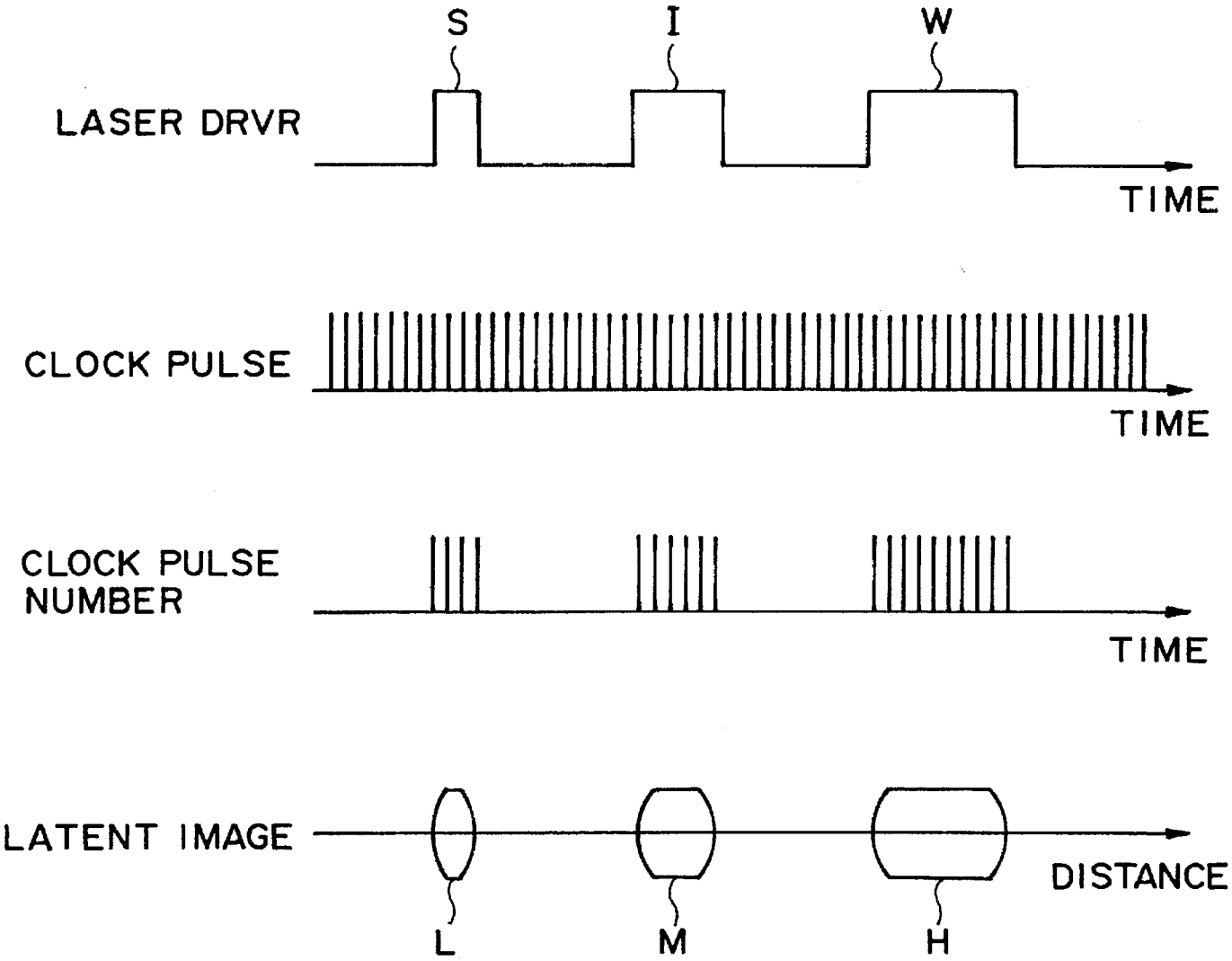
FIGS. 2A, 2B and 2C illustrate image signals.
FIG. 2D illustrates latent images of pixels corresponding to FIGS. 2A, 2B and 2C.

In FIG. 1, an optical image of an original 31 to be copied is projected through a lens 32 onto an image pick-up element 33 such as a CCD. The image pick-up element 33 divides the original image into a number of pixels, and produces a photoelectrically converted signal corresponding to the density of each of the pixels. The analog image signal generated by the image pick-up element 33 is transmitted to an image signal processor or processing circuit 34, where the signal is further converted to pixel image signals each having an output level corresponding to the density of the pixel. Such signals are further transmitted to a pulse width modulator or circuit 35. The pulse width modulating circuit 35 produces a laser driving pulse for each of the inputted pixel image signals, the laser driving pulse having a width (time length) corresponding to the density level. As shown in FIG. 2A, a wide driving pulse W is produced for a high density pixel image signal, whereas for the low density pixel image signal, a narrow width driving pulse S is produced. For an intermediate density pixel image signal, the produced driving pulse I has an intermediate width.

The laser driving pulse produced by the pulse width modulating circuit 35 is fed to a semiconductor laser 36 to emit a laser beam within a time period corresponding to the pulse width. Therefore, the semiconductor laser 36 is driven for a long period of time for a high density pixel, and is driven for a short period of time for a low density pixel. Thus, the photosensitive drum 40 is exposed to the laser beam in a longer range in the main scan direction for the high density pixel, and is exposed thereto in a short range in the main scan direction for the low density pixel. In this manner, the dot size of the latent image is different depending on the density of the pixel. Accordingly, the toner consumption is larger for the higher density pixel than for the lower density pixel. The latent images for the low, intermediate and high density pixels corresponding to the pulses S, I and W, are designated in FIG. 2D by L, M and H.

The laser beam **36*a* emitted by the semiconductor laser 36 is deflected by a rotational polygonal mirror 37, and is imaged as a spot on the 10 photosensitive drum 40 through a lens 38 in the form of an f-θ lens or the like and by way of a fixed mirror 36 for directing the laser beam 36*a* to the photosensitive drum 40 (image bearing member). In this manner, the laser beam 36*a* scans the drum 40 in a direction (main scan direction) substantially parallel with a rotational axis of the photosensitive drum 40, so that an electrostatic latent image corresponding to the original 31** is formed.

The photosensitive drum 40 in this embodiment is an electrophotographic photosensitive drum rotatable in a direction indicated by an arrow and is provided with a surface of amorphous silicon, selenium or OPC or the like. After it is uniformly discharged by an exposing device 41, it is uniformly charged by a primary charger 42. Thereafter, it is scanned by the laser beam modulated in accordance with the image signal as described above, so that an electrostatic latent image is formed corresponding to the image information signal. The electrostatic latent image is reverse-developed by a developing device 44 using a two component developer 43 containing toner particles and carrier particles, into a visualized image (toner image). Here, the reverse development is a development in which the toner particles electrically charged to the same polarity as the latent image are deposited in an area of the photosensitive member that has been exposed to the beam. The toner image is transferred by a transfer charger 49 onto a transfer material 48 carried on an endless transfer belt 47 which is stretched between two rollers 45 and 46 and is rotated in the direction indicated by an arrow.

The transfer material 48 now having the toner image is separated from the endless belt 47, and is fed to an fixing device (not shown), where the image is fixed into a permanent image. Residual toner remaining on the photosensitive drum 40 after the image transfer operation, is removed by the cleaner 50.

For the sake of simplicity of description, the image forming apparatus comprises only one image forming station including the photosensitive drum 40, the exposure device 41, the primary charger 40, the developing device 44 or the like. In the case of a color image forming apparatus, however, image forming stations corresponding to the cyan, magenta, yellow and black colors, for example, are sequentially arranged along the movement direction of the transfer material carrying belt 47, and the electrostatic latent images for the respective colors produced by color separation of the original image are sequentially formed on the photosensitive drums, and the latent images are developed by the developing devices containing the corresponding color toners. The images are sequentially transferred onto the transfer material 48 carried on the transfer material carrying belt 47.

Figure 3:
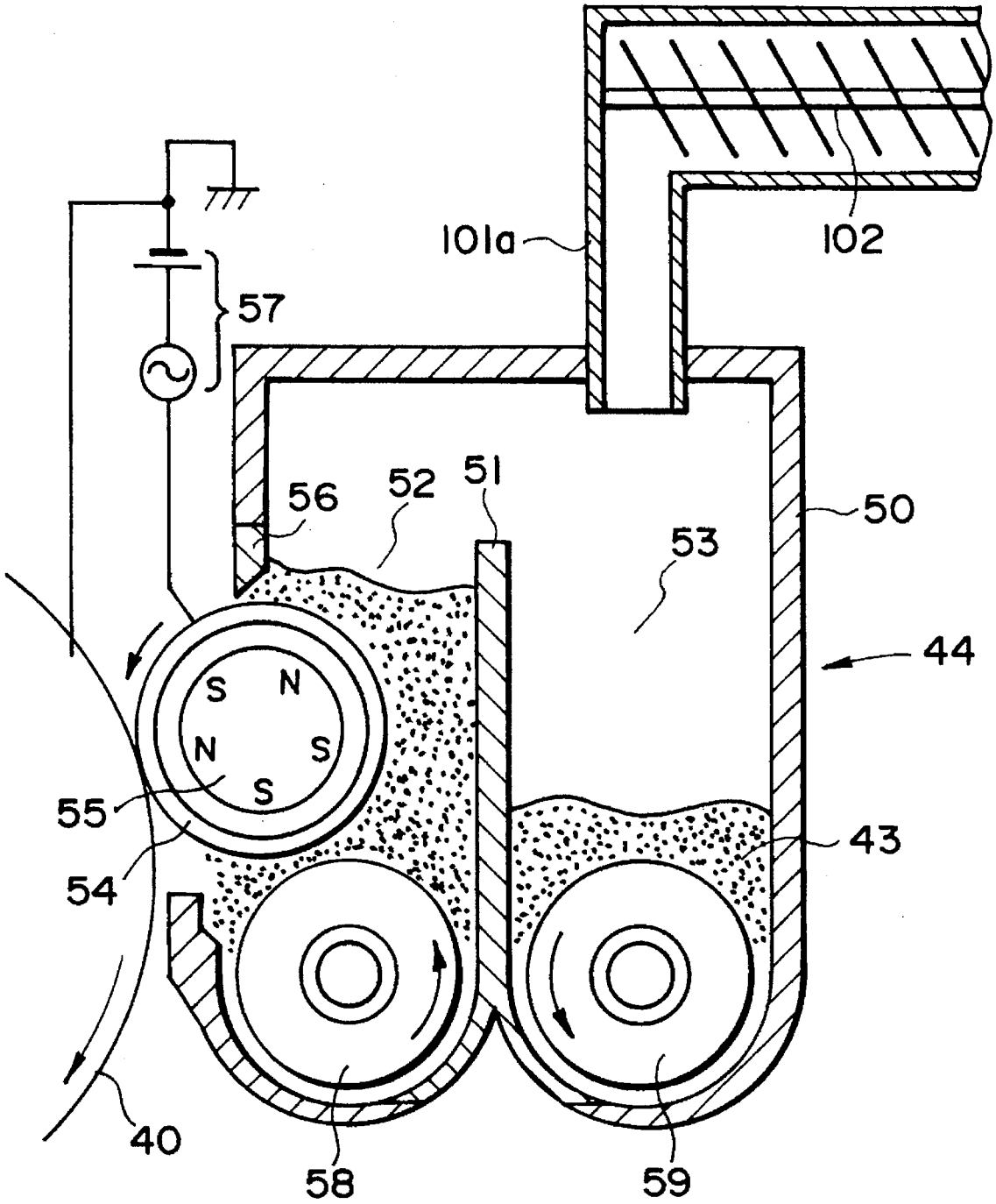
FIG. 3 is a sectional view of an example of a developing apparatus.

Referring to FIG. 3, there is shown an example of such a developing device 44. As shown in FIG. 3, the developer container 50 of the developing device 44 is disposed opposed to the photosensitive drum 40. The inside thereof is partitioned by a partition wall 51 extending in the vertical direction into a first chamber (developing chamber) 52 and a second chamber (stirring chamber) 53. In the first chamber, there is a developing sleeve 54 of non-magnetic material which receives developer from the first chamber 52 and which is rotatable in the direction indicated by an arrow.

Within the developing sleeve 54, a stationary magnet 55 is disposed. The developing sleeve 54 functions to carry a layer of the two component developer containing the magnetic carrier particles and non-magnetic toner particles, and a thickness of the developer layer is regulated by a blade 56. The developing sleeve 54 thus conveys the developer to a developing zone where the developing sleeve 54 is opposed to the photosensitive drum 40, and supplies the developer to the photosensitive drum 40 to develop the electrostatic latent image. In order to increase the developing efficiency, that is, the ratio of the toner contributable to the development to the total amount of the toner, the developing sleeve 54 is supplied with a developing bias voltage which is in the form of superimposed DC voltage and AC voltage.

The first chamber 52 and the second chamber 53 are provided with developer stirring screws 58 and 59, respectively. The screw 58 stirs and conveys the developer in the first chamber 52, and the screw 59 stirs and conveys the existing developer 43 in the second chamber and the toner T supplied by rotation of a feeding screw 102 through a toner port 101*a* of the first toner container 101 of a first toner supply device A, which will be described hereinafter. By doing so, the toner content is made uniform. The partition wall 51 is provided with a developer passing opening (not shown) for communication between the first and second chambers 52 and 53 at each of the front and rear ends in FIG. 3. The developer in the first chamber 52 having a low toner content by the consumption thereof for the developing operation, is fed into the second chamber 53 through one of the passage by the feeding force of the screws 58 and 59, and the developer having a recovered toner content in the second chamber 53 is fed into the first chamber 52 through the other passage.

In order to correct the developer content in the developing device 44 which has been changed by the developing operation for the electrostatic latent image (first toner density controlling mode), levels of output signals of the image signal processing circuit 44 are counted on the basis of pixels. In the FIG. 1 embodiment, the counting operation is as follows.

The output signal of the pulse width modulation circuit 35 is supplied to one input port of AND gate 64. To the other input port of the AND gate, clock pulses (FIG. 2B) are supplied from a clock pulse oscillator 65. Therefore, the number of clock pulses corresponding to the pulse width of the laser driving pulse S, I or W, that is, to the density of the pixel, are outputted from the AND gate 64, as shown in FIG. 2C. The number of clock pulses is counted and accumulated by a counter 66. The count of the pulses provided by the counter 66 (integrated clock pulse number C) thus corresponds to the amount of the toner to be consumed by the developing device 44 for one toner image of the original 31. The pulse integration signal C is fed to a CPU 67, and is stored in a RAM 68. The CPU 67 calculates, on the basis of the pulse integration signal C, the driving period for the feeding screw 102 which is required to supply the amount of toner T corresponding to the amount of toner consumed by the developing device 44 from the first toner container 101 into the developing device. It drives the motor driving circuit 69 to drive a motor 104 for the period of time thus calculated. In this manner, the driving period of the motor 104 is long if the pulse integration is large, and if it is small, the driving period is short.

The driving force of the motor 104 is transmitted to the supply screw 102, and the supply screw 102 supplies the toner T from the first toner container 101 to supply the proper amount of the toner to the developing device 44. The toner supply operation is carried out after completion of each developing operation for single images.

As will be understood from the foregoing, the toner is supplied into the developing device in accordance with the image signal obtained by the photoelectric conversion of the image of the original to be copied, not in accordance with the actual toner content of the developer. Therefore, it supplies toner based on a prediction of the toner consumption. For this reason, the actual toner content tends to be away from the target toner content.

One of the causes for the error derives from the toner supply error by the supply screw 102, as described hereinbefore, and another cause derives from the development of the latent image.

When the ambient condition, such as the temperature or humidity, changes, the amount of electric charge of the toner particles which are triboelectrically charged by friction with the carrier particles, changes. Therefore, even if a number of the same pattern latent images are developed, the toner consumption is different depending on the ambient condition. Therefore, the prediction on the basis of the image signal might not correctly correspond to the actual toner consumption. If this occurs, the toner content may be outside of the target level range even if the amount of toner corresponding to the prediction is supplied into the two component developer.

In order to correct the error attributable to the supply system and the error attributable to the developing operation, the apparatus of FIG. 1 carries out a second toner content controlling mode operation. The second mode operation is carried out immediately after completion of the image forming operation. More particularly, in a single copy mode in which the image forming operation is completed after one copy is produced from one original, the second mode operation is carried out immediately after completion of the single image forming operation, and in a continuous copy mode in which a preset number of copies are continuously produced from the single original, and thereafter, the image forming operation is completed, the second mode toner content control operation is carried out immediately after the image forming operations for the preset number of copies.

The toner content control in the second mode may be carried out immediately before the start of an image forming operation. In any case, the toner content control operation in the second mode is as follows in the embodiment of FIG. 1.

There is provided a reference image signal generator or generating circuit 72 to produce a reference image signal having a signal level corresponding to a predetermined density (halftone level, for example). The reference image signal from this circuit 72 is supplied to the pulse width modulating circuit 35 to produce a laser driving pulse having a pulse width corresponding to the predetermined density. The laser driving pulse is supplied to the semiconductor laser 36 to drive the laser 36 to emit a beam during the period corresponding to the pulse width, and the produced beam scans the photosensitive drum 40 (the counter 66 is not operated at this time). By doing so, a reference electrostatic latent image corresponding to the predetermined image density is formed on the photosensitive drum 40, and the reference electrostatic latent image is developed by the developing device 44. Thus, a reference toner image in the form of a "patch", which is illuminated with light from a light source 73 such as an LED or the like. The light reflected thereby is received by a photoelectric transducer 74. The output signal of the photoelectric transducer 74 corresponds to the density of the reference toner image. Therefore, the output signal corresponds to the actual toner content in the two component developing device in the developer 44.

The output signal of the photoelectric transducer 74 is fed to one of the inputs of a comparator 75. To the other input of the comparator 75, a reference signal corresponding to a predetermined toner content (target toner content) of the developer 43 is supplied from a reference voltage signal source 76. Therefore, the comparator 75 compares the predetermined toner content and the actual toner content in the developing device. The comparator 75 generates an output signal indicative that the actual toner content of the developer 43 in the developing device 44 is higher than the predetermined level or that it is lower. If there is no difference therebetween, an output signal indicative of that event is produced.

The output signal from the comparator 75 is supplied to the CPU 67, which, in turn, in this embodiment, respond to the output signal from the comparator 75 to control the subsequent toner supply operation in the following manner.

When the actual toner content detected by the photoelectric transducer 74 is the same as the predetermined level, the CPU 67 cancels the pulse integration signal C stored in the RAM 68, and the toner supply operation in the first mode for the image forming operation is carried out in the manner described in the foregoing.

When the actual toner content of the developer 43 detected by the photoelectric transducer 74 is lower than the predetermined level, that is, the amount of the toner is insufficient, the CPU 67 drives the supply screw 102 to supply the necessary amount of toner into the developing device 44. More particularly, in response to the output signal from the comparator 75, the time period for the screw rotation required for the supply of the necessary toner to the developing device 44, is calculated, and then, the CPU controls the motor driving circuit 69 to rotate the motor 104 for a predetermined time period, so that a sufficient amount of toner is supplied to the developing device 44 from the first container 101. For a subsequent image formation operation for an original, the toner supply operation is carried out in the manner described in the foregoing.

When the actual toner content of the developer detected by the photoelectric transducer 74 is larger than the predetermined level, that is, when the toner supply carried out in the first mode control has been too much, the amount of excess toner in the developer is calculated on the basis of the output signal from the comparator 75, by the CPU 67. For a subsequent image formation operation, toner is supplied so as to reduce the excess amount of toner. In this embodiment, for a subsequent image forming operation, the amount of predicted toner consumption per one image is calculated on the basis of the image signals, and on the basis thereof (amount of predicted toner consumption data per one image and the excessive toner amount data), the number of copies for consuming the excess amount of toner, is calculated. The image forming operation is carried out without toner supply for the thus obtained number of copies. In other words, the excessive amount of toner is consumed by the calculated number of image formations without supply of the toner. After the excessive amount of toner is consumed, the toner supply operation in the first mode is carried out in the manner described hereinbefore.

By the toner content control in the second mode, the error attributable to the toner supply system and the error attributable to the developing operation, are properly corrected to restore the toner content to the target level. In another method of toner content detection using the photosensor, light is directly projected to the developer carried on the sleeve 54 or to the developer in the developer container 50, and the light reflected is detected. However, in the case of black toner containing carbon black as the coloring material dispersed in the resin materials, this method is true not usable. This is because there is no substantial difference in the spectral reflection indexes between the toner and black carrier (black ferrite coated with very thin resin material or black ferrite dispersed resin), and therefore, the reflected light from the mixture of the toner and the carrier does not indicate the toner content in the developer. When the black toner colored by the carbon black is used, it is preferable that the toner content of the developer is detected by forming the patch image on the photosensitive member in the manner described in the foregoing and detecting the amount of light reflected thereby. This method is usable for measurement of the toner content of the developer in the case where a non-black or chromatic toner (colored by dye) is used.

It is inconvenient that the toner content control in the second mode is carried out during the continuous image forming operation in the continuous copy mode, for the following reason. If this is true, then the patch image formation, the patch image density measurement and the corresponding toner supply, are repeated after completion of image formation image for the respective images in the continuous copy mode. Then, the copy speed significantly decreases.

In view of this, the toner content control in the second mode, if the continuous copy mode is selected, is carried out before the start of the continuous image forming operation or after completion of the continuous image forming operation, and it is not carried out during the continuous image forming operation.

However, during the continuous copy operation, a small error attributable to the developing operation occurs, but it is tolerable because the error is not significant.

If the error attributable to the supply system is added, the error is expanded to a nonnegligible extent. In order to suppress or substantially remove the toner supply error attributable to the supply system, in other words, in order to increase the accuracy of the toner supply by the toner supply system, an improvement has been made. As shown in FIG. 1, the toner supply system is divided into a first toner container 101 and a second toner container 111, and the toner is supplied from the first toner container 101 to the developer container 50 by a first supply screw 102. Toner is supplied from the second toner container 111 to the first toner container 101, by a second supply screw 112.

The toner accommodating capacity of the first toner container 101, that is, the volume thereof is smaller than that of the toner accommodating capacity, that is, the volume of the second toner container 111. Therefore, the change in the toner density at the position of the screw 102 can be reduced. Thus, the toner feeding efficiency variation of the supplying screw 102 can be minimized.

It is desirable that the second feeding screw 112 is controlled such that a variation in the amount of toner in the first toner container 101 is reduced. From this standpoint, it is desirable that the height or the level of the powder surface in the first toner container 101 is maintained in a predetermined range by the control of the toner supply to the first toner container 101. By doing so, the toner density variation at the supply screw 102 can be substantially eliminated, so that the toner supply accuracy of the screw 102 becomes extremely high. In other words, the amount of the toner actually supplied to the developer container 50 accurately corresponds to the required amount of the toner calculated on the basis of the image signal.

Description now will be made as to the toner supply accuracy required for the supply system. The highest accuracy is required when the toner consumption is large. In other words, the most severe condition occurs when a solid (black) original image is continuously copied for the maximum preselectable number of copies. The required supply accuracy is more severe if the tolerable range of the toner content is narrower. If it is assumed that the maximum presettable continuous copy number is 100, and that the tolerable range of the toner content is ±1% by weight, then the required toner supply accuracy is approx. ±5%. This can be accomplished according to the present invention.

If, in FIG. 1, the first toner container is omitted, and the second container 111 is directly connected to the developing device 44 (conventional example), then the supply accuracy is approx. ±20–30%, and therefore, it is substantially difficult to maintain stably the toner content in the conventional toner supply system.

Figure 4:
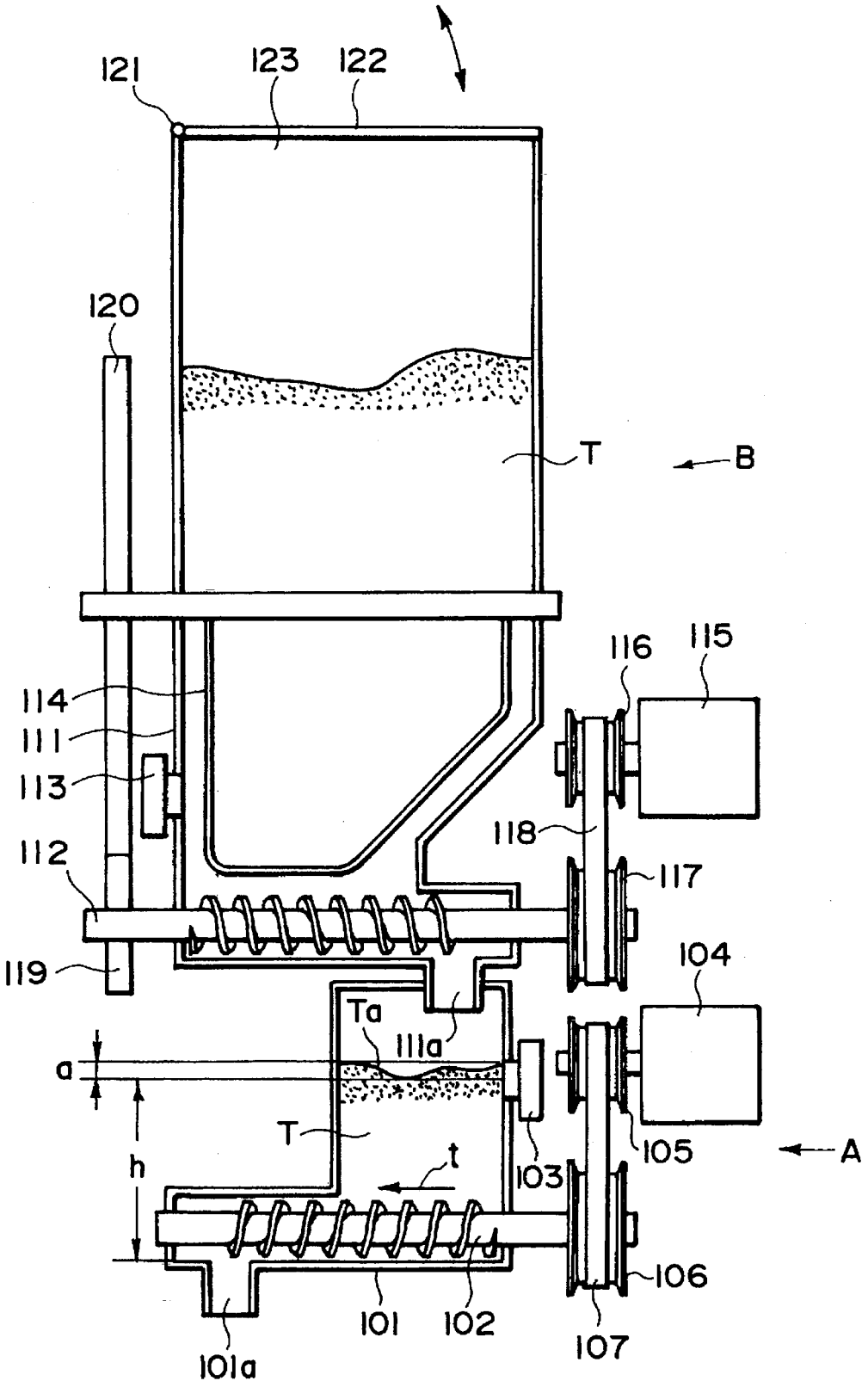
FIG. 4 is a sectional view of an example of a toner supply device.

Referring to FIG. 4, the description now will be made as to an example of a toner supply device usable in the image forming apparatus of FIG. 1.

As shown in FIG. 4, the toner supply device of this example comprises a first toner supply device A and a second toner supply device B, and the functions thereof are separate. The conventional toner supply device had two functions, namely, the function of containing the toner to be supplied and the function of supplying the necessary amount of toner to the developing device. In this embodiment, the function of containing the toner is allotted to the second toner supply device B, and the function of supply of the toner to the developing device is allotted to the first toner supply device A.

The first toner supply device A comprises a first toner container 101 for containing the toner T and a first supply screw 102 for supplying the toner T from this container to the developing device 44, and a powder surface level sensor 103 for sensing the level of the surface Ta of the toner T in the container. The second toner supply device B comprises a large capacity second toner container 111 for containing the toner T, a second supply screw 112 for feeding toner from the second toner container 111 to first toner container 101, a remaining amount detecting sensor 113 for detecting any insufficiency of the remaining amount of the toner in the container, and a stirring member 114 for stirring the toner in the container.

The second container 111 is provided with a cover 122 for opening a container opening 123 when the cover 122 is rotated in the direction indicated by an arrow about an axis 121. When the reduction of the toner beyond a predetermined level in the second container 111 is sensed by the sensor 113, the event is displayed on a display (not shown). The operator then opens the cover 122, and manually supplies the toner into the second container 111 through the opening 123.

As for the sensors 103 and 113, a piezoelectric sensor or the like is usable.

In operation, a copying operation starts. Then, as described hereinbefore, the toner supply period is calculated on the basis of the count C. The first motor 104 is driven for a period thus calculated. The first supply screw 102 is driven through a drive transmission mechanism, and a part of the toner T in the first container 101 is supplied into the container 50 of the developing device 44. In this example, the drive transmission member comprises pulleys 105 and 106 with teeth and timing belt 107. However, another type such a gear train or motor direct drive is usable.

By the toner supply into the developing device 44, the toner powder level Ta in the first container 101 decreases. After the completion of the toner supply action into the developing device 44 in the first mode or second mode, the first container 101 is supplied from the second toner supply device B with the amount of the toner corresponding to the reduction detected by the powder surface sensor 103. For example, an output of the powder surface sensor 103 is supplied to the CPU 67, and a drive signal is supplied from the CPU 67 to the second motor 115 to drive the second motor 115 until the powder surface Ta is restored to the target level. In this operation, second supply screw 112 is rotated by way of the drive transmission elements 116, 117 and 118. Thus, the toner in the second toner container 111 is supplied into the toner container 101 of the first toner supply device A, so that the toner powder surface Ta in the first toner container 101 is maintained constant.

Figure 5:
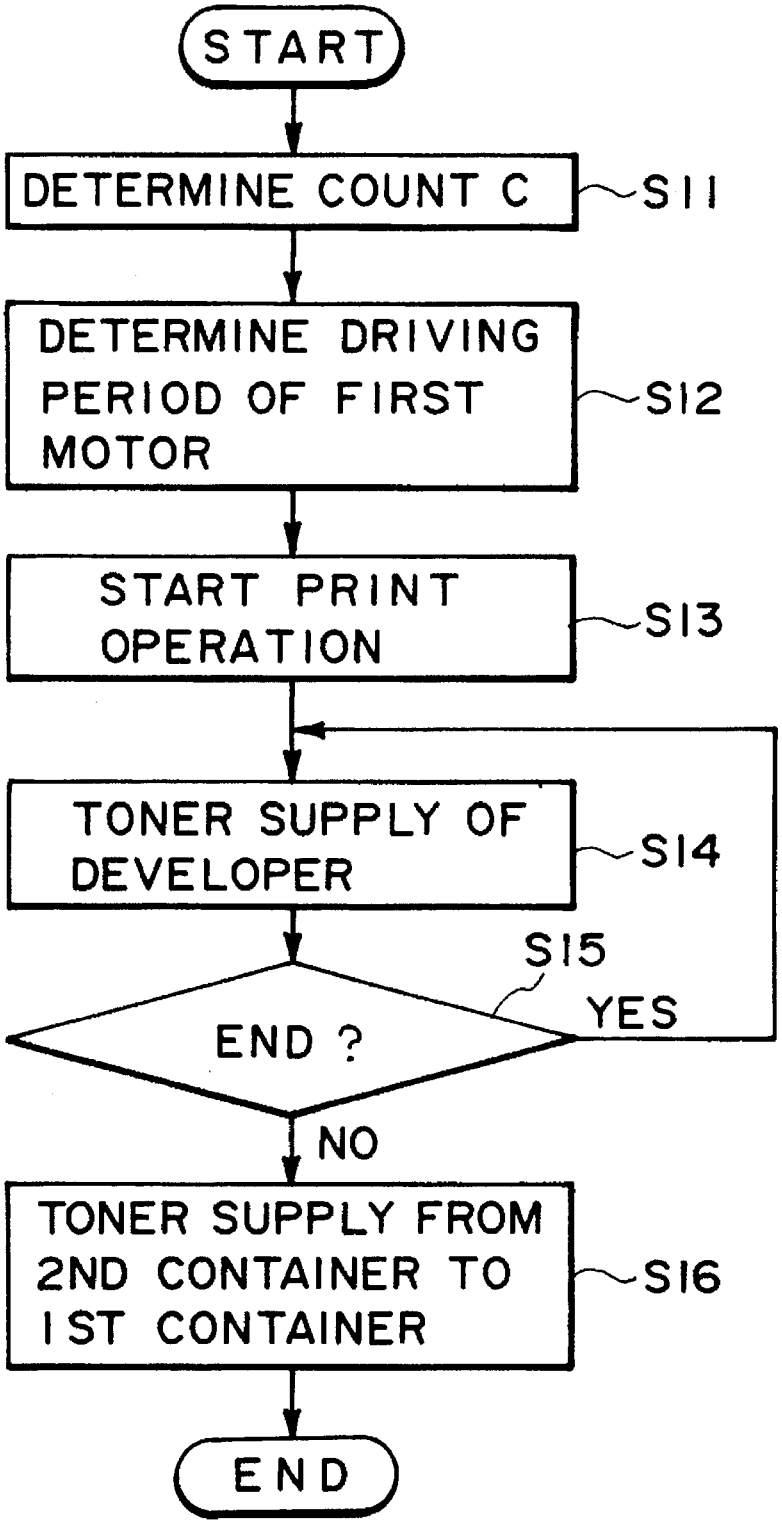
FIG. 5 is a flow chart of an example of a toner supply control operation.

Referring to FIG. 5, the above-described operation will be further described in detail.

When the copying operation starts, the clock pulse integration signal C is determined at step S11. At the next step S12, a determination is made as to the driving period for the first motor 104 for driving the first supply screw 102 to directly supply toner into the developing device 44. Subsequently, the printing operation is started at step S13, and in interrelation with the developing and toner consuming action, the first supply screw 102 is driven at step S14, by which a part of the toner T contained in the first toner container 101 is supplied into the developing device 44.

During this toner supply operation, the toner powder level Ta of the toner T in the first container 101 gradually decreases, and therefore, there is no influence to the supply efficiency of the screw 102. However, if the toner is supplied from the second toner container 111 into the first toner container 101 while the powder surface Ta decreases, then the powder surface Ta is disturbed by the falling of the supply toner with the possible result of influence to the amount of the toner supplied to the developing device 44. In consideration of this, a determination is made as to whether the toner supply operation into the developing device 44 is completed or not, at step S15. If so (yes), then the amount of toner corresponding to the reduction detected by the powder surface detection sensor 103, from the second toner supply device B, is supplied into the first toner container 101, at step S16. Namely, when the toner T in the first container 101 is stabilized, the toner is supplied from the second container 111 into the first container 101.

In this manner, the level of the powder surface Ta of the toner in the toner container 101 in the first toner supply device A is maintained at all times in a range a indicated in the FIG. 4. Strictly speaking, however, the toner powder level changes in the range a. If a height h from the container bottom to the powder surface detecting sensor 103, is properly selected, the ratio of a relative to h is small. By doing so, the pressure change of the toner at the bottom portion in the first toner container 101 can be reduced, so that the variation in the bulk density becomes negligibly small. Therefore, a high accuracy toner supply is possible. It is desirable that the height h is not less than 20 mm and not more than 50 mm.

The stirring member 114 in the second container 111 is rotated in interrelation with the second supply screw 112 through gears 119 and 120.

Careful observations has revealed that, in the initial state after the start of toner supply, the powder surface Ta in the first container 101 starts to decrease at the upstream portion thereof, before the start of the decrease at the downstream part thereof, with respect to the toner feeding direction by the screw 102 (arrow t). In other words, in the initial stage, the downstream part T'a of the powder surface Ta of the toner powder T, is substantially static.

Figure 6:
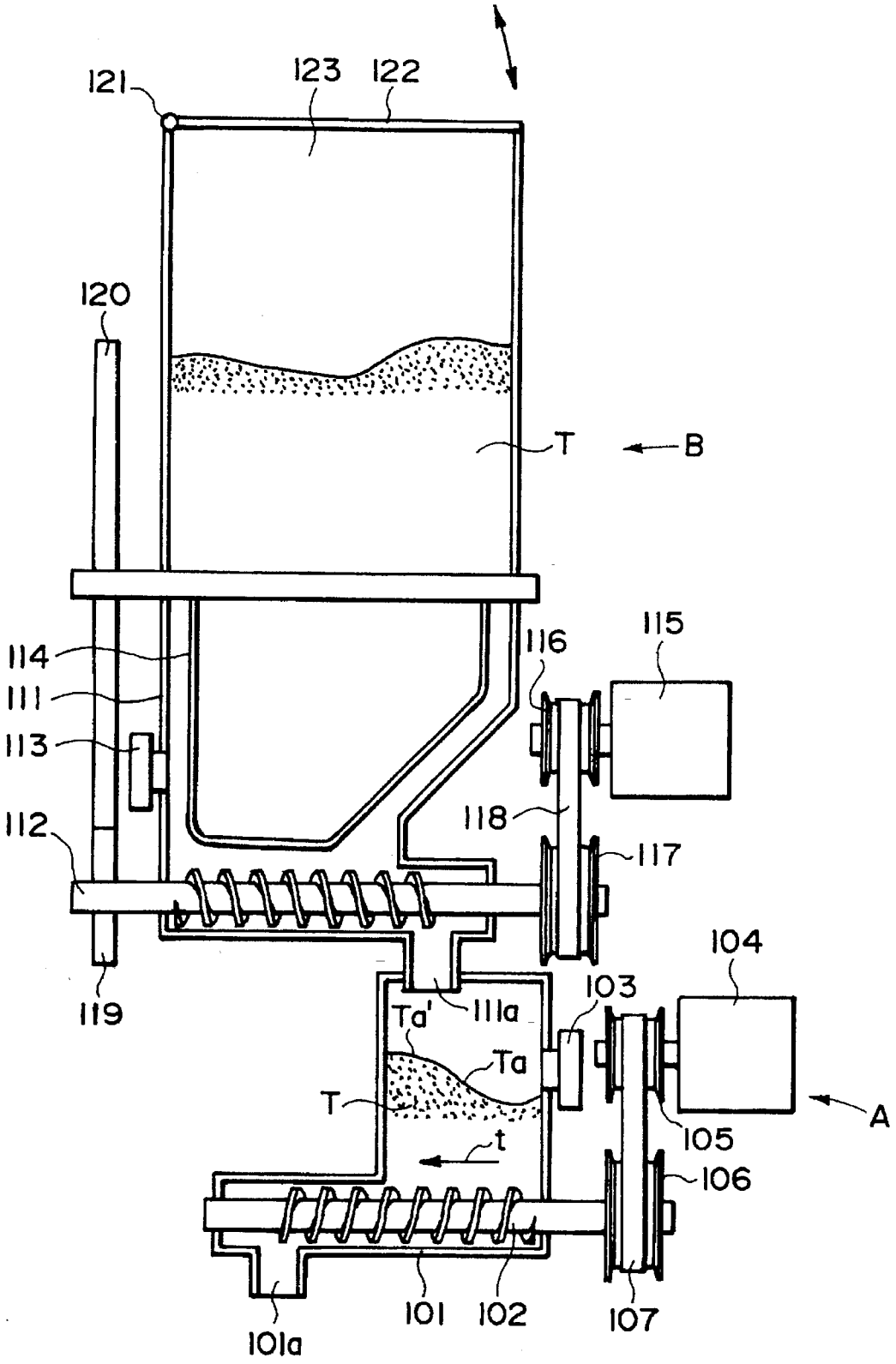
FIG. 6 illustrates another example of a toner supply device.

On the basis of the above finding, in FIG. 6, for example, a toner discharge opening 111*a* of the second toner container 111 is disposed right above the part T'a of the powder surface of the toner, and simultaneously with the start of the rotation of the screw 102, the toner is supplied onto the static powder surface T'a. The CPU 67 drives the motor 104 and the motor 115 simultaneously and for the same time period on the basis of the count C.

In this manner, toner does not fall directly on the portion which is being lowered, and therefore, the degree of disturbance to the lower powder surface is small. Therefore, even if toner is supplied into the first container 101 when the toner is supplied into the developing device 50, the toner feeding efficiency of the feeding screw 102 is hardly influenced.

It should, however, be noted that a in the apparatus in which the first and second supply screws 102 and 112 are simultaneously operated, whether the toner falls from the second container to any position of the toner powder surface Ta in the first container 101 (even if it falls at the upstream part in the toner feeding direction t), the variation in the toner feeding efficiency of the screw 102 is very small as compared with the conventional apparatus, and therefore, the toner supply accuracy can be sufficiently accurately maintained. In other words, in the apparatus of FIG. 4, the first and second supply screws 102 and 112 may be operated simultaneously and for the same period on the basis of the count C. In the apparatus in which the first and second supply screws 102 and 112 are simultaneously driven for the same period, it is preferable that the amount of the toner supply per unit time by the second supply screw 112 is equal to or lower than the amount of toner supply per unit time by the first supply screw 102. In this manner, the level of the toner powder surface Ta in the first toner container 102 is prevented from rising beyond the range a.

In the case where a toner supply operation is started to the first container 102 after stopping the operation of the first screw 102, as in the first described embodiment (FIG. 4), the following drawback occurs. If the amount of the toner T in the first container 102 quickly reduces with the continuous image forming operation, for example in the case where the hole surface solid black copy continues for a number of copies (very rare case), then the toner supply efficiency of the first screw 102 quickly changes with a drawback of deterioration of the toner supply accuracy. However, in an apparatus in which the first and second supply screws 102 and 112 are substantially simultaneously operated, a quick reduction of the toner in the first container 102 can be prevented, and therefore, the above-described inconveniences are effectively prevented.

Even in an apparatus in which the first and second supply screws 102 and 112 are operated substantially for the same period and substantially simultaneously on the basis of the count C, it is preferable that the second supply screw 112 is operated on a basis of the signal from the sensor 103 as in the first described embodiment (FIG. 4) after completion of the operations of the first and second supply screws 102 and 112 responsive to the count C, so that the toner powder surface Ta in the first container 101 is restored to the target level.

Figure 7:
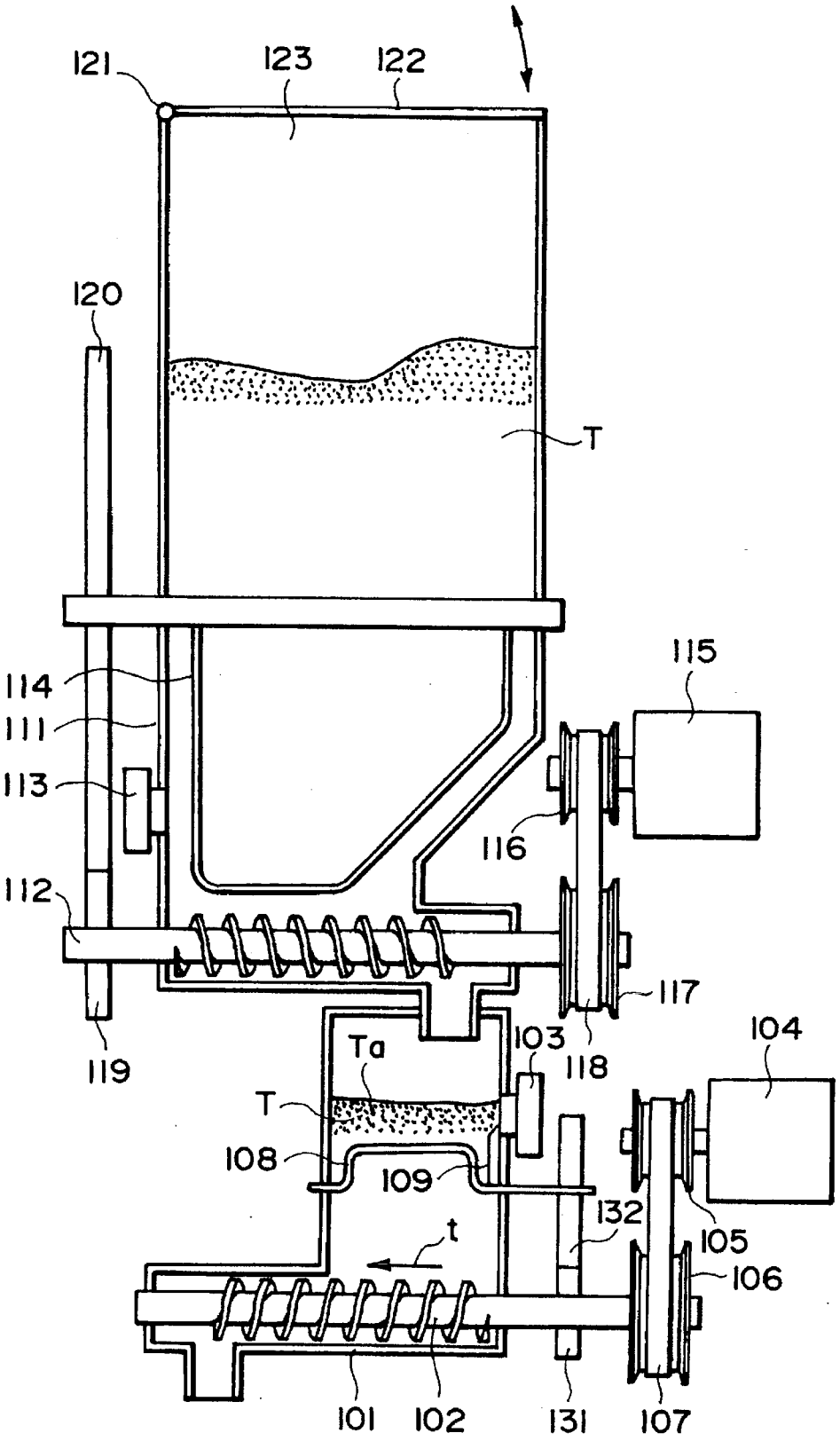
FIG. 7 illustrates a further example of a toner supply device.

Referring to FIG. 7, there is shown another example in which a stirring member 108 is provided in the first toner container 101 of the toner supply device of FIG. 7, and a sensor wiper 109 is provided to clean the sensing surface of the powder surface detecting sensor 103. In these respects, it is different from the apparatus of FIG. 7.

Unlike the second toner supply device B, the first toner supply device A is such that the height of the powder surface Ta in the first container is low, and therefore, a toner bridge hardly occurs. However, as described hereinbefore, the toner powder surface Ta in the first container 101 starts to lower at the upstream portion in the toner feeding direction t in response to the toner supply to the developing device 44, as shown in FIG. 6. In consideration of this, the toner supply device of this example is provided with a stirring member 108, which is rotationally driven by the first supply screw 102 through gears 131 and 132 (drive transmission mechanism), so that the toner powder surface Ta decreasing by the toner supply to the developer container 50 is maintained horizontal. By doing so, the supply accuracy is further increased.

On the other hand, the powder level sensor is usually a piezoelectric type as the powder surface detecting sensor 103. However, the surface of the sensor is contaminated with the toner, with the possible result of incapability of sensing the powder surface. Therefore, the sensor surface is cleaned by a sensor wiper 109 to prevent inaccurate detection of the powder surface. The sensor wiper 109 is rotatably driven by the first feeding screw 102 through gears 101 and 102. However, the driving method for the sensor wiper 109 and the stirring member 108 may be such that they are driven by the second motor 115, or another known driving method.

The amount of toner T in the second container 111 gradually decreases with operation of the apparatus from the level provided by the supply of the toner by the operator, so that the supply efficiency of the second supply screw 112 gradually increases. Therefore, in an apparatus in which the first and second screws 102 and 112 are operated in response to the count C, the rotational speed of the screw 112 is desirably higher by 10–50% in the case where the second container 111 still contains a large amount of the toner T than when the remaining amount of the toner T in the second container 111 is small.

In the foregoing example, the toner supply mechanism is in the form of a screw, but it may be a coil spring, or roller.

In the foregoing example, the toner control operation in the first mode (the toner supply to the developer container on the basis of the count C), is carried out in the single copy mode and in the continuous copy mode. However, it is a possible alternative that the toner content control in the first mode is carried out only in the continuous copy mode. In this case, in the single copy mode, only the second mode toner content control operation is carried out.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a developing unit including a developer carrying member for carrying a developer comprising toner particles and carrier particles, and opposed to an image bearing member;

a first toner container for containing toner particles to be supplied to said developing unit;

a second toner container for containing toner particles to be supplied to said first toner container;

toner supply means for supplying toner particles from said second toner container to said first toner container;

detecting means for detecting an amount of the toner particles in said first toner container;

control means, responsive to an output of said detecting means, for controlling said toner supply means so as to substantially maintain a constant amount of the toner particles in said first toner container; and ratio control means for controlling the supply of toner particles supplied to said developing unit from said first toner container to provide a substantially constant ratio of toner particles to carrier particles in said developing unit.

2. An apparatus according to claim 1, wherein timing of supply of toner particles controlled by said toner supply means is different from timing of supply of the toner particles controlled by said ratio control means.

3. An apparatus according to claim 1, wherein said first toner container has an inlet and an outlet disposed at positions different in a horizontal direction.

4. An apparatus according to claim 1, wherein said toner supply means controls the supply of toner particles to provide a constant surface level of toner in said first toner container.

5. An apparatus according to claim 1, wherein said second toner container comprises a hopper for containing toner particles to be supplied to said first toner container, said hopper having a capacity larger than that of said first toner container.

6. An apparatus according to claim 1, wherein said developer has a flowability.

7. A developing apparatus comprising:

a developing unit for developing an electrostatic image on an image bearing member, said developing unit including a developer carrying member for carrying a developer and a developer container for containing the developer to be carried on the developer carrying member;

a hopper for storing developer supplied from an outside source;

an intermediate container for containing developer to be supplied to said developing unit;

feeding means for feeding developer from said hopper to said intermediate container;

detecting means for detecting an amount of toner in said intermediate container;

control means, responsive to said detecting means, for controlling said feeding means so as to maintain the amount of developer in said intermediate container at a predetermined level; and a sensor for sensing a quantity of developer in said hopper, wherein said sensor is disposed above a position where developer is fed out by said feeding means.

8. An apparatus according to claim 7, wherein said control means controls said feeding means to maintain a predetermined level of developer in said intermediate container.

9. An apparatus according to claim 7, wherein said feeding means includes a screw for feeding developer in its axial direction.

10. An apparatus according to claim 7, wherein said intermediate container has a capacity smaller than that of said hopper.

11. An apparatus according to claim 10, wherein said developer container has a capacity smaller than that of said hopper, and larger than that of said intermediate container.

12. An apparatus according to claim 7, wherein the developer has a flowability.

13. An apparatus according to claim 7, further comprising display means responsive to an output of said sensor, for displaying an occurrence of a quantity of developer lower than a predetermined level.

* * * * *

UNITED STATES PATENT AND TRADEMARK OFFICE

CERTIFICATE OF CORRECTION

PATENT NO. 5,652,947
DATED July 29, 1997
INVENTOR(S) : Masami IZUMIZAKI

It is certified that error appears in the above-identified patent and that said Letters Patent is hereby corrected as shown below:

COLUMN 1:
Line 25, "the" (second occurrence) should be deleted; and
Line 34, "at" should read --in--.

COLUMN 2:
Line 2, "the" (third occurrence) should be deleted; and
Line 8, "the" should be deleted.

COLUMN 4:
Line 37, "an" should read --a--.

COLUMN 5:
Line 51, "the" (second occurrence) should be deleted.

COLUMN 7:
Line 32, "the" should be deleted.

UNITED STATES PATENT AND TRADEMARK OFFICE

CERTIFICATE OF CORRECTION

PATENT NO. 5,652,947
DATED July 29, 1997
INVENTOR(S) Masami IZUMIZAKI

It is certified that error appears in the above-identified patent and that said Letters Patent is hereby corrected as shown below:

COLUMN 8:
Line 7, "true" should be deleted;
Line 8, "because" should read --true because--; and
Line 27, "image" (second occurrence) should be deleted.

COLUMN 9:
Line 1, "the" (second occurrence) should be deleted;
Line 3, "the" (second occurrence) should be deleted;
Line 47, "the" (second occurrence) should be deleted;
~~Line 53, "~~the" should be deleted; and
Line 65, "thus" should read --of time thus--.

COLUMN 10:
Line 4, "a" should read --as a--;
Line 7, "the" (first occurrence) should be deleted;
Line 16, "the" should be deleted; and
Line 55, "the" (first occurrence) should be deleted.

UNITED STATES PATENT AND TRADEMARK OFFICE

CERTIFICATE OF CORRECTION

PATENT NO. 5,652,947
DATED July 29, 1997
INVENTOR(S): Masami IZUMIZAKI

It is certified that error appears in the above-identified patent and that said Letters Patent is hereby corrected as shown below:

COLUMN 11:

Line 62, "the" (second occurrence) should read --a--.

Signed and Sealed this

Twelfth Day of May, 1998

Bruce Lehman

*Attest:*

BRUCE LEHMAN

*Attesting Officer*

*Commissioner of Patents and Trademarks*